US005355856A

United States Patent [19]

Paul et al.

[11] Patent Number: 5,355,856

[45] Date of Patent: Oct. 18, 1994

[54] HIGH PRESSURE DIFFERENTIAL FUEL INJECTOR

[76] Inventors: Marius A. Paul; Ana Paul, both of 1120 E. Elm Ave., Fullerton, Calif. 92631

[21] Appl. No.: 191,769

[22] Filed: Feb. 2, 1994

Related U.S. Application Data

[63] Continuation of Ser. No. 918,240, Jul. 23, 1992, abandoned.

[51] Int. Cl.[5] ..... F02M 39/00

[52] U.S. Cl. ..... 123/446; 123/467

[58] Field of Search ..... 123/446, 447, 450, 467, 123/451, 500, 501

[56] References Cited

U.S. PATENT DOCUMENTS

| | | | |
|---|---|---|---|
| 2,279,010 | 4/1942 | Nichols | 239/533.8 |
| 2,282,562 | 5/1942 | Cole . | |
| 2,397,136 | 3/1946 | French . | |
| 2,930,323 | 3/1960 | Kessner | 103/44 |
| 3,469,793 | 9/1969 | Guertler | 239/533 |
| 3,610,529 | 10/1971 | Huber | 239/96 |
| 3,729,274 | 4/1973 | Hatz et al. | 417/387 |
| 3,777,977 | 12/1973 | Regneault et al. | 239/96 |
| 4,156,560 | 5/1979 | Checklich et al. | 251/30 |
| 4,247,052 | 1/1981 | Gray | 239/585 |
| 4,271,807 | 1/1981 | Links et al. | 123/506 |
| 4,373,490 | 2/1983 | Kimata et al. | 123/446 |
| 4,381,750 | 5/1983 | Funada | 123/446 |
| 4,398,519 | 8/1983 | Tissot et al. | 123/446 |
| 4,426,977 | 1/1984 | Taplin et al. | 123/446 |
| 4,440,132 | 4/1984 | Terada et al. | 123/446 |
| 4,440,134 | 4/1984 | Nakao et al. | 123/447 |
| 4,449,507 | 5/1984 | Mayer | 123/446 |
| 4,459,959 | 7/1984 | Terada et al. | 123/446 |
| 4,480,619 | 11/1984 | Igashira et al. | 123/446 |
| 4,485,787 | 12/1984 | Kato et al. | 123/446 |
| 4,499,876 | 2/1985 | Yamamoto | 123/446 |
| 4,541,385 | 9/1985 | Eheim et al. | 123/447 |
| 4,566,416 | 1/1986 | Berchtold | 123/458 |
| 4,603,671 | 8/1986 | Yoshinaga | 123/467 |
| 4,621,605 | 11/1986 | Carey, Jr. et al. | 123/451 |
| 4,628,881 | 12/1986 | Beck et al. | 123/446 |
| 4,665,881 | 5/1987 | Wade | 123/447 |
| 4,667,638 | 5/1987 | Igashira et al. | 123/446 |
| 4,674,688 | 6/1987 | Kanesaka | 239/533.8 |
| 4,709,679 | 12/1987 | Djordjevic | 123/447 |
| 4,798,186 | 1/1989 | Ganser | 123/467 |
| 4,957,085 | 9/1990 | Sverdlin | 123/467 |
| 4,976,244 | 12/1990 | Eckert | 123/447 |
| 4,987,887 | 1/1991 | Kelly | 123/467 |
| 5,076,236 | 12/1991 | Yu et al. | 123/467 |
| 5,109,822 | 5/1992 | Martin | 123/447 |
| 5,143,291 | 9/1992 | Grinsteiner | 123/446 |
| 5,168,855 | 12/1992 | Stone | 123/467 |
| 5,201,295 | 4/1993 | Kimberely et al. | 123/467 |

FOREIGN PATENT DOCUMENTS

| | | | |
|---|---|---|---|
| 521722 | 5/1940 | United Kingdom | 239/533.8 |

*Primary Examiner*—E. Rollins Cross
*Assistant Examiner*—Thomas N. Moulis
*Attorney, Agent, or Firm*—Bielen, Peterson & Lampe

[57] ABSTRACT

A fuel injector system designed to generate an ultra-high, injection pulse with an instant cut-off, the injector system including a distributor component for distributing high pressure fluid from a fuel supply to a fuel injector component and a connected booster component in which the high pressure fuel is increased in pressure to an ultra high fluid pressure by a piston mechanism having large diameter and small diameter pistons. The high pressure fuel hydraulically lifts a needle valve and is ejected through discharge nozzles at the end of the injector component. High pressure fuel in the injector component forces the reseating of the needle valve after fuel discharge.

12 Claims, 5 Drawing Sheets

CONV PUMP
P2
P1
ECM

CONV PUMP
P1
P2
ECM

HIGH PRESSURE DIFFERENTIAL FUEL INJECTOR

This is a continuation of application Ser. No. 07/918,240 filed 23 Jul. 1992, now abandoned.

BACKGROUND OF THE INVENTION

This invention relates to fuel injectors and in particular to extremely high pressure periodic injectors where fuel is injected in discreet pulses at pressures sufficient to cause gasification upon injection. This invention relates to our application Ser. No. 885,304, filed 18 Apr. 1992, entitled, FUEL INJECTOR SYSTEM.

In many applications, the efficiency of an engine increases as the operating pressures increase. In reciprocal engines, it is desirable that the injection pressure exceed the volumetric pressure of the combustion chamber by a factor of ten. The use of confined volume precombustion chambers and the design of hyper-pressure engines requires that in some instances, the injection pressure be boosted to one hundred to two hundred thousand psi. At these pressures, structural components of the injector system become large and cumbersome with the potential of leaks and rupture an unavoidable consideration.

The injector systems of this invention are designed to enable ultra high pressure injections to be achieved without substantial modification in the fuel delivery system. Ultra high pressures are localized in sections of the injector unit. In this manner, the fuel supply lines, common rail, and injector feed lines can be maintained at conventional injection pressures with the exceedingly high pressure of injection isolated in an injector component and in portions of a booster component. In addition to substantial savings in the cost of components, the isolation of hyper-pressure fluids primarily in the injector allows for greater precision in the start and stop of the injection cycle.

SUMMARY OF THE INVENTION

The fuel injector system of this invention is designed to generate an ultra-high, injection pulse with an instant cutoff. The system is designed to localize the ultra-high, fluid pressure to permit use of conventional high pressure supply and delivery components. In the preferred embodiments the ultra-high fluid pressure is confined to a portion of an injector component and a portion of a booster component which utilizes a conventional high pressure fluid supply to hydraulically boost the pressure of the fuel in the discharge line. The generated ultra high pressure of fuel in the discharge line forces retraction of a needle valve that blocks discharge orifices in the tip of a nozzle in the injector component. The needle valve is reseated in the nozzle tip by the mechanical force of a compression spring combined with the hydraulic force of high pressure fluid from the fluid supply acting on the needle valve. In certain embodiments, a distributor component having a slide valve switching mechanism selectively delivers high pressure fluid from a common rail to select subcomponents of the assembly.

Other features disclosed in the embodiments described include fluid circuits to allow low pressure fuel to be supplied to the injector for ultra high pressure discharge, and hydraulic switching structures to generate a high frequency, pulsed discharged spray. These and other features of the fuel injector system provide for delivery of an ultra high pressure, high speed, injection for a variety of engines and combustors is described.

DETAILED DESCRIPTION OF THE PREFERRED EMBODIMENTS

The ultra high pressure fuel injection system is shown in several embodiments in which certain of the components are interchangeable. Both electromechanical and purely mechanical activation means are shown to enable the hydraulic actuation concepts embodied in the ultra high pressure injector system to be adapted to both ground vehicles and aircraft.

Figures 1, 1A:
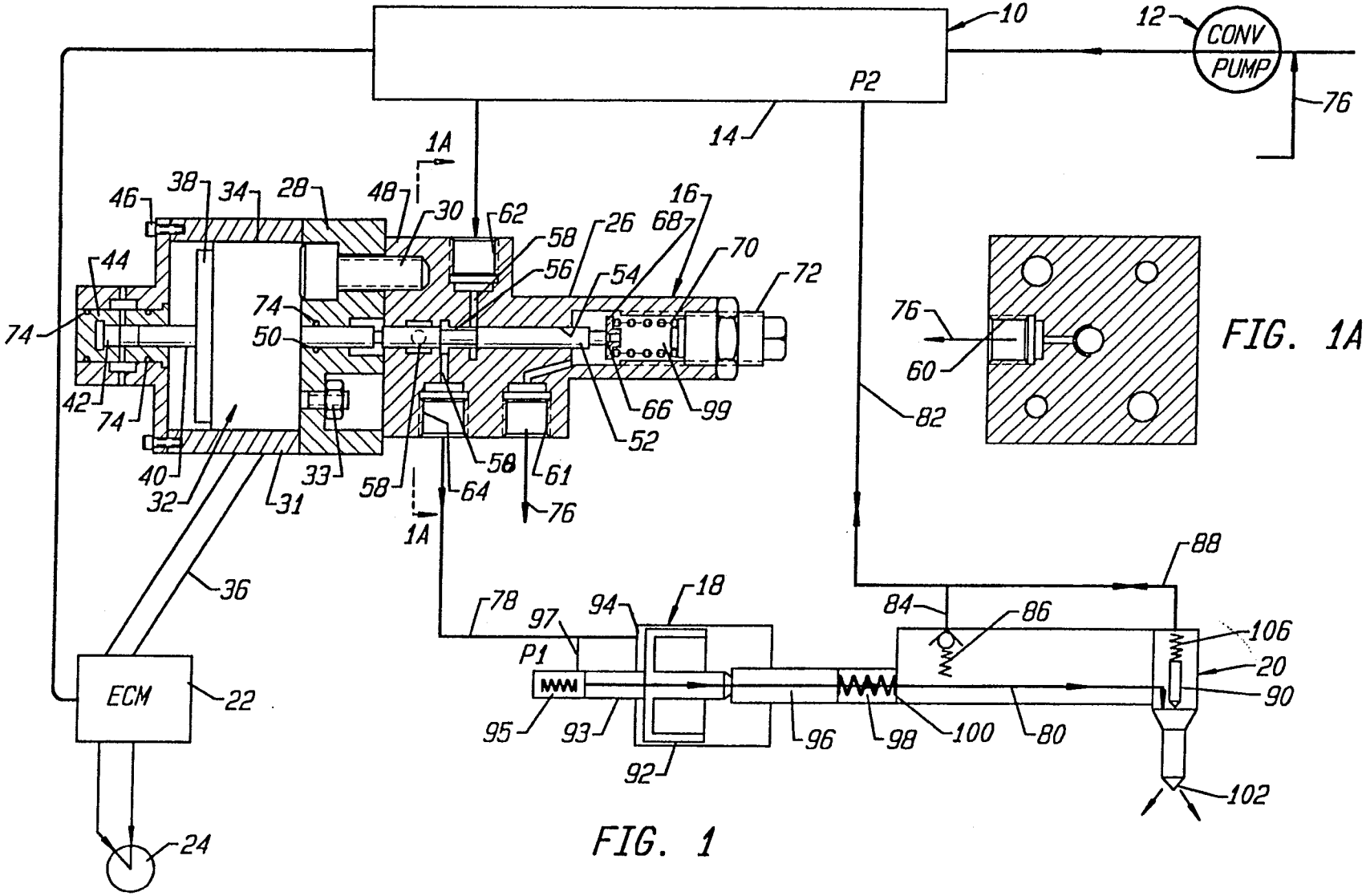
FIG. 1 is a cross sectional view, partially schematic that illustrates the injector system of this invention.
FIG. 1*a* is a cross sectional view taken on the lines 1*a*—1*a* FIG. 1
Figures 2, 2A:
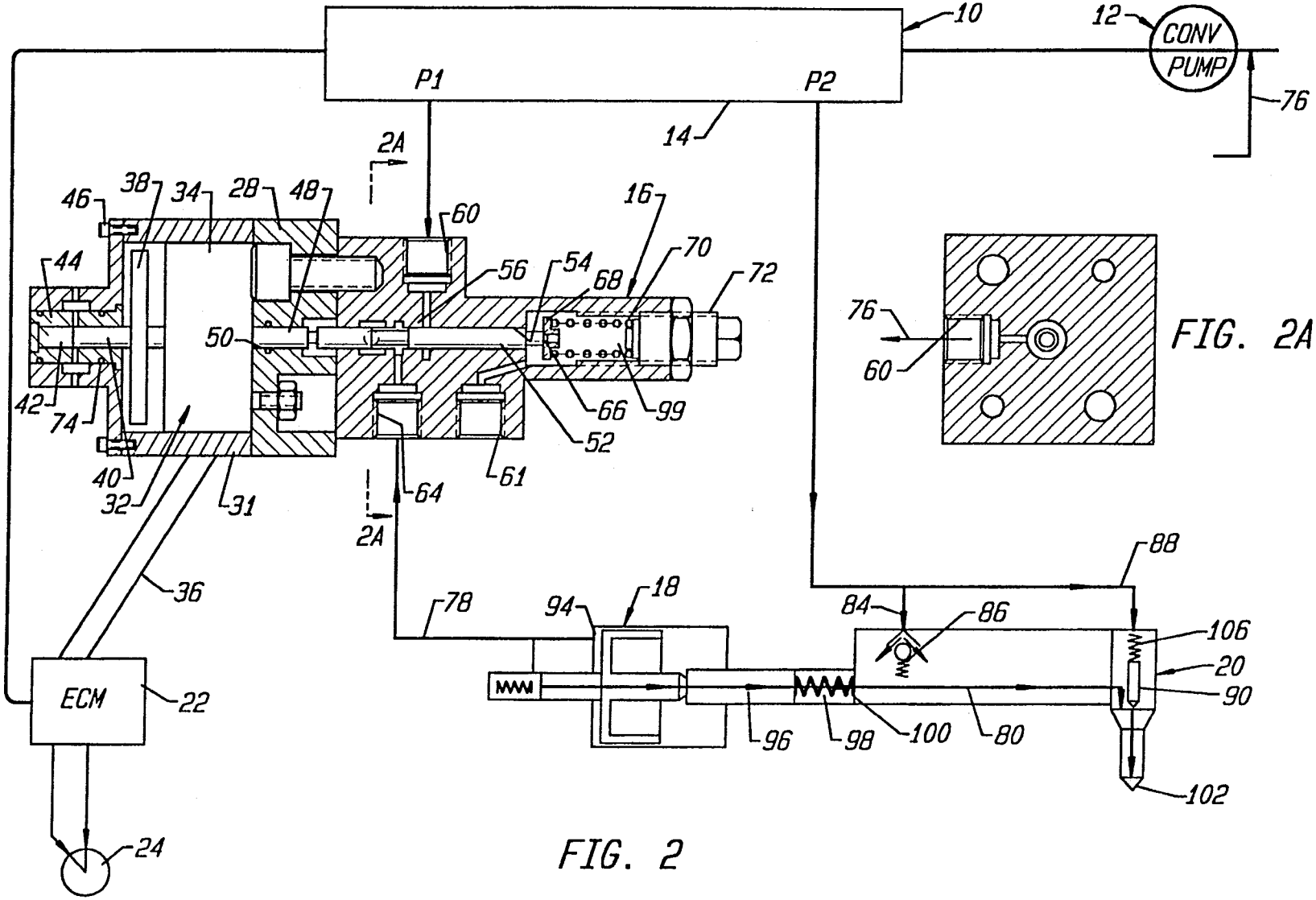
FIG. 2 is a cross sectional view, partially schematic, of the system of FIG. 1 in a different actuating position.
FIG. 2*a* is a cross sectional view taken on the lines 2*a*—2*a* in FIG. 2.

Referring to the embodiment of the fuel injector system of FIGS. 1, 1*a*, and 2, the fuel injector system, designated generally by the reference numeral 10, includes conventional components such as a high pressure pump 12 and an accumulator rail 14 in combination with a distributor 16 and a booster 18 coupled to an injector 20. The injector assembly of FIG. 1 is shown under control of an electronic control module 22 that monitors the pressure in the common accumulator rail 14 to assure that a supply of fuel at an appropriate operating pressure is maintained. The electronic control module also monitors the injection cycling using timing sensors 24 to initiate and terminate the fuel injection at an appropriate period in the engine cycle.

The distributor 16 has a high pressure hydraulic block 26 connected to a flange member 28 by bolts 30. The flange member 28 is in turn connected to a housing 31 for a solenoid 32. The solenoid 32 has a solenoid coil 34 electrically connected by conductors 36 to the electronic control module 22. A linear armature 38 is actuated by the electronic field generated in the coil 34 upon activation by the electronic control module 22. The armature 38 has a damping probe 40 which is inserted into a hydraulic stop 42 in an end cap 44 connected to the solenoid housing 31 by machine screws 46. The armature 38 has a push rod 48 that extends through a bore 50 to contact the end of a cylindrical slide valve 52.

The slide valve 52 is situated in a central, cylindrical bore 54 in the distributor block 26. The valve 52 has a constricted segment 56 that selectively aligns with one or more hydraulic passages, 58 that are internally located in the distributor block 26. The hydraulic passages 58 are connected to specific hydraulic line terminals 60, 61, 62, and 64 which characterize the function of the internal passages 58. The valve stem 52 also has an end pin 66 that contacts a cap 68 on the end of a compression spring 70 which is preloaded by a threaded adjustment mechanism 72 at the end of the distributor block. Various O-ring seals 74 minimize leakage in the high pressure distributor 16.

The high pressure distributor 16 is hydraulically connected to the booster 18 which is integrated with the injector 20. The booster 18 utilizes the high pressure fuel delivered from the distributor 16 through feed line 78 to generate ultra high pressure fuel through injector discharge line 80. The discharge line 80 is connected to the common rail 10 by a feed line 82 having a branch line 84 protected by a ball valve 86. A needle valve closure branch 88 communicates with the needle valve 90 as shown in the schematic depiction of the injector and booster in FIGS. 1 and 2. The booster 18 magnifies the pressure of fuel in the common rail after delivery to the discharge line 80 by use of a large diameter piston 92 in a large diameter cylinder 94 in combination with a connected small diameter piston 96 in a small diameter bore 98. The small diameter piston has a return spring 100 for bias return of the combination piston mechanism after the activated pulse stroke delivers ultra high pressure fuel through the discharge line 80 and out the injector discharge orifices 102. The large piston 92 has a projection 93 inserted into a hydraulic stop 95 having a relief passage 97 which is eclipsed by the projection as the piston returns to a retracted position.

In operation, the electronic control module 22 or other activating means activates the solenoid 31 causing the armature 40 to be drawn to the coil 34 displacing the push rod 48. The displacement of the push rod in turn displaces the slide valve 52 such that the constricted segment 56 aligns with the passages of the hydraulic terminals 62 and 64, as shown in FIG. 1, to connect high pressure hydraulic fuel from the common rail to the cylinder 94 behind the large piston 92. The end of the valve 52 projecting into the spring chamber 99 displaces fuel therein, which is discharged from line terminal 61 through return line 76. High pressure fuel behind the large piston 92 drives the piston against the small piston 96 displacing the piston against the compression spring 100, and forcing ultra high pressure fluid through discharge line 80 to the nozzles 102. Ball valve 86 acts as a check to prevent the ultra high pressure fuel from returning through the branch feed line 84 to the rail 14.

With reference to FIGS. 2 and 2*a*, once the solenoid 32 is deenergized, the armature 38 is returned against the hydraulic stop 42 by action of the expanding compression spring 70 which acts against the cap 68 on an end pin 66 of the slide valve 52 in contact with the push rod 48 of the armature. In this return position, the constricted segment 56 enables communication of the hydraulic passage of the hydraulic terminal 64 with the passage of the hydraulic terminal 60 such that the feed line 78 connects to a low pressure return line 76 to return displaced fluid from the large cylinder 94 to the low pressure side of the pump 12. With high pressure being release from the booster 18, the small piston 96 retracts by action of the compression spring 98 allowing a new charge of high pressure fuel to be delivered through the branch line 84 on retraction of the check valve 86. Without the ultra high pressure fuel in the feed line 80 countering the high pressure on top of the needle valve 90, from the high pressure fuel in branch line 88, the needle valve reseats by hydraulic force and the added force of the compression spring 106, abruptly closing the nozzle orifices 102.

Figure 4:
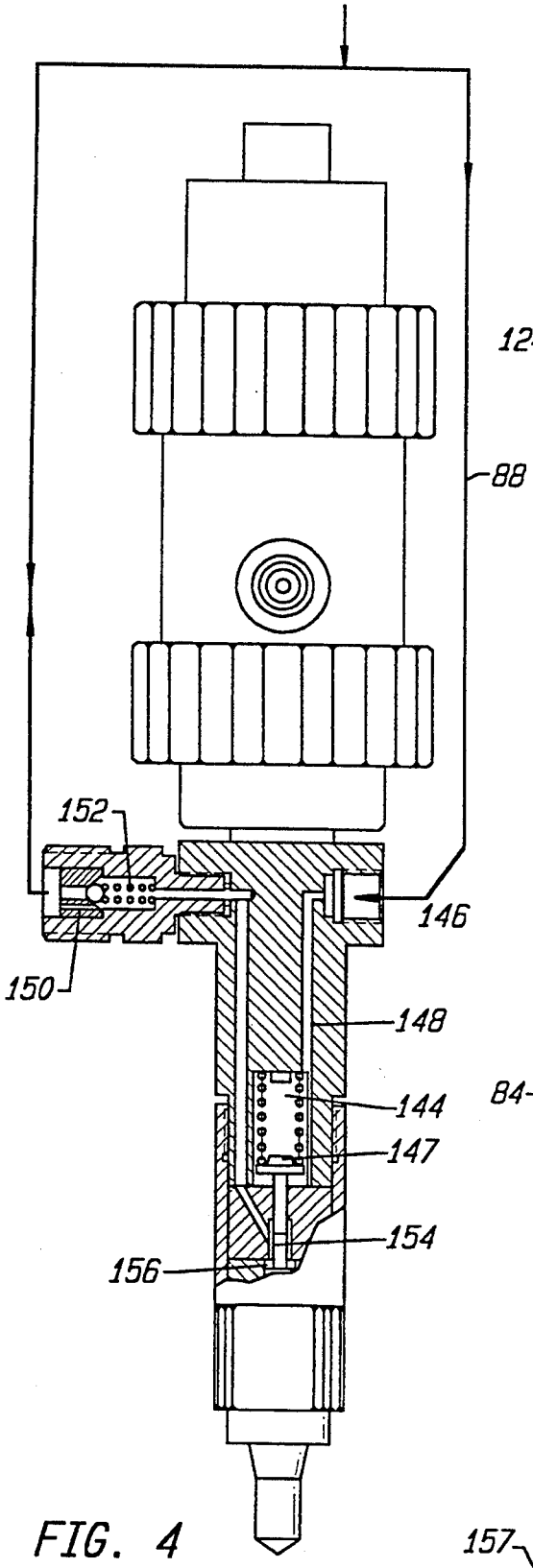
FIG. 4 is a side elevational view, partially in cross section, of the device of FIG. 3.
Figure 3:
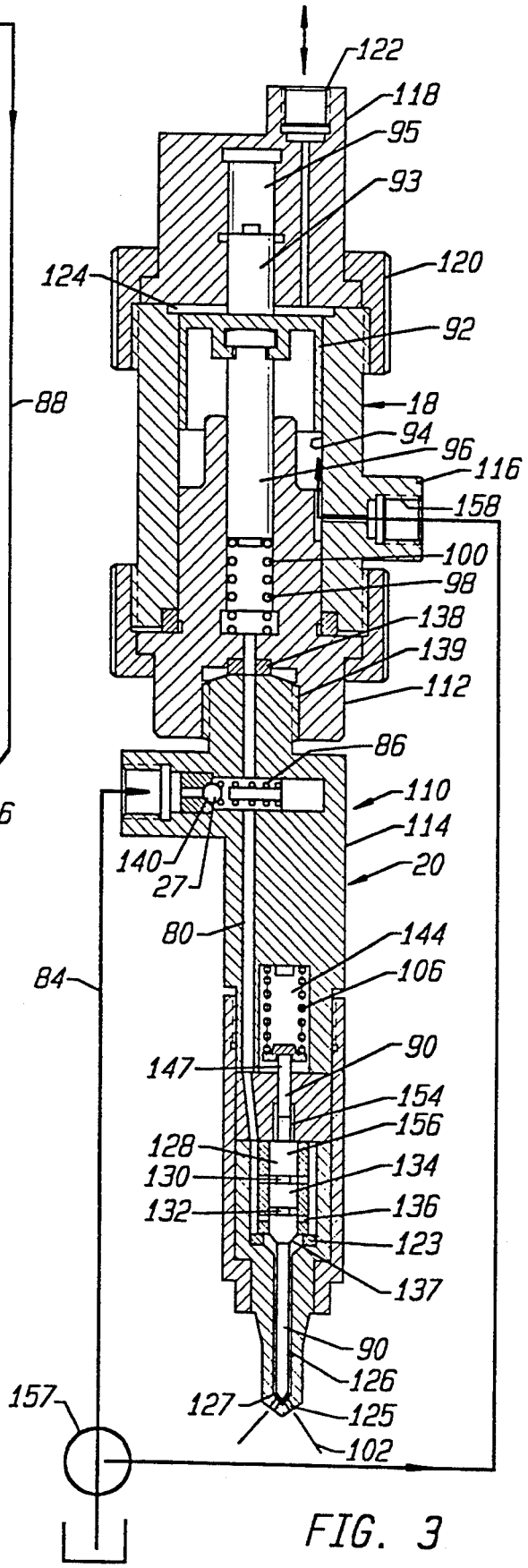
FIG. 3 is a cross sectional view of a combination booster component and injector component useable in the system of FIG. 1.

In the embodiment of FIGS. 3 and 4, the fuel injector 20 and the booster 18, shown schematically in FIGS. 1 and 2, are combined and integrated into a boosted injector unit 110. Except for the flutter feature added to the nozzle to create a high frequency pulsed spray by inducing a hydraulic instability into the discharge, the injector 20 is typical of the type useable in the ultra high pressure system described with reference to FIGS. 1 and 2. The combined booster and injector component 110 shown in FIGS. 3 and 4 is preferred for use with a distributor of a type shown in FIGS. 1 and 2.

In the construction shown in FIGS. 3 and 4, the booster 18 has a core 112 threadably connected to a body segment 114 of the injector 20. The core 112 houses the internal small bore 98 in which the small diameter piston 96 is slidably engaged against the bias of the compression spring 100. The small diameter piston 96 is coupled to the large diameter piston 92 that reciprocates in a large cylinder 94 formed in an outer housing 116 of the booster 18. The large diameter piston 92 has a projection 93 that inserts into a hydraulic stop chamber 95 to absorb the abrupt return of the large piston upon deactivation of the injection process. The hydraulic stop assembly is contained within a cap 118 coupled to the housing 116 by a bushing 120.

High pressure fuel for hydraulic operation of the booster is delivered through hydraulic terminal 122 to the fluid chamber 124 located between the large diameter piston 92 and the cap 118. Upon displacement of the large piston 92, the small piston 96 also displaces with a multiplication factor on pressure equal to the diameter of the large piston, D divided by the diameter of the smaller piston d, that is, D/d. This ultra high pressure fuel is delivered through discharge line 80 to a plenum 123 to discharge orifices 102 at the nozzle tip 126. The needle valve 90 has a needle tip 125 that engages a seat 127 at the nozzle tip 126 to block the orifices 102 after discharge.

Preferably, the high pressure fluid passes through a segment 128 of the needle valve 90 that acts as a slide valve by appropriate positioning of bypass constrictions 130 and 132 with cross passages 134 and 136. Bypass passage 134 has a constricted opening such that a fluid pressure acting against the needle valve drops and becomes insufficient to retain the needle valve in the retracted position allowing the valve to move toward closure. As it approaches closure, the unconstricted passage 136 communicates with the fuel discharge supply line 80 maximizing flow and forcing the needle valve against the compression spring 106 by hydraulic action of the ultra high pressure fluid on the concentric shoulder 137 of the valve 90. This process is repeated in a hydraulic instability that causes flutter to the needle valve and a pulsed spray at the discharge orifices 102.

The needle valve 90 has a cylindrical body segment 139 that extends to a spacer 138. During displacement of the small diameter piston 96, the high pressure pulse of fuel acts against the ball 140 of the check valve 86 preventing back flow of ultra high pressure fuel through the low pressure fuel supply line 84. When the pulse of fuel has been expended, and the pressure drops in the ultra high pressure line 80 the high pressure fuel from branch line 88, directed to needle valve spring chamber 144 through line terminal 146 and internal passage 148, is directed at the blunt end 147 of the needle valve to bias the needle valve toward a closed position.

A bleed line 150 that bypasses check valve 152 allows high pressure fuel from the common rail 10 to be supplied to a small damping chamber 154 that coacts with an enlarged segment 156 of the needle valve 90 to control the initial rate of injection by forcing hydraulic fuel in the chamber 152 back through the bleed passage 150 on retraction of the needle valve 90.

Retraction is tempered by the damping effect allowing a gradual slope to initial fuel injection to create a low level, preignition pulse of fuel to be delivered for pilot and main sequence of fuel delivery for improved efficiency. At the conclusion of injection, high pressure fuel flow is allowed to pass to the chamber 152. Together with the high pressure supply through line 148 to chamber 144 and the force of the compression spring 106, the termination of injection is abrupt and firm.

In the modified system of FIGS. 3 and 4, the low pressure fuel from the low pressure fuel pump 157 resupplies the discharge line 80 through check valve 140 as the piston 92 is retracted by force of the compression spring 98 assisted by the hydraulic pressure through line terminal 158 that balances the switched open return to the low pressure side through line terminal 122. The large diameter piston 92 is returned to its preoperative position by spring 100. In the embodiment described, the ultra high pressure fuel is restricted to the small bore 98 of the booster chamber and the discharge line 80 and plenum 123 of the injector 20.

Figure 5:
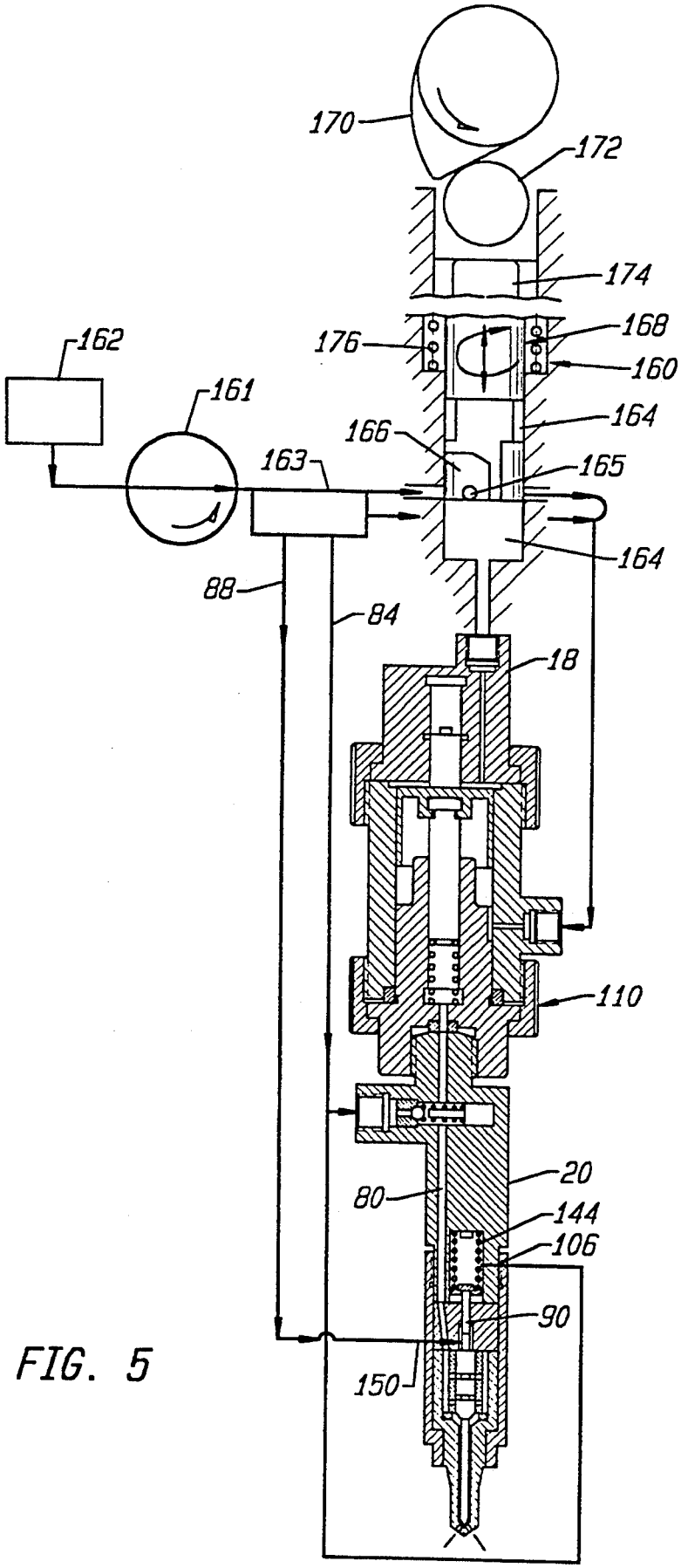
FIG. 5 is a cross sectional view of a combined booster component and injector component in combination with a mechanical actuator shown schematically.

Referring now to FIG. 5, the boosted injector unit 110 formed of the combination booster 18 and fuel injector 20, is equipped with a mechanical distributor 160 particularly adaptable for aircraft use or other environments where electrical actuation is undesirable. In the embodiment shown in FIG. 5, a moderate pressure, rotary fuel supply pump 161 draws fuel from a fuel source 162 and supplies it to a rail 163 with a fuel feed line 84 that resupplies the discharge line 80 in the fuel injector 20. Concurrently, fuel from the common rail 163 supplies the needle valve chamber 144 through line 84 to assist the spring 106 in urging the needle valve 90 to a closure position when the high pressure pumping action ceases to be applied to the discharge line 80. During retraction of the needle valve on activation of the high pressure pulse, a feed line 150 allows a measured quantity of fluid to be returned to the rail via the bleed line check valve (not visible) as described with reference to FIG. 4.

The moderate pressure from the rotary pump 161 feeds a pumping chamber 164 through a pilot hole 165 that is periodically eclipsed by a helical shield 166 on a reciprocal piston 168. The piston 168 is actuated by a rotating cam 170 connected to the engine drive that contacts a roller 172 at the end of a push rod (shown fragmented) 174 that is in turn connected to the piston 168. Contact is maintained against the cam 170 by a conventional compression spring 176 that returns the piston 168 on the return stroke. By rotation or twist of the piston 168, by conventional gear means (not shown), the helical shield 166 can be repositioned with respect to the pilot hole 165 allowing different measures of fuel in the chamber 164 to be pumped to the booster 18. This varies the stroke of the large and small piston mechanism 167, and hence the quantity of fuel ejected through ultra high pressure line 80. As fuel is pumped to the booster 18, the booster amplifies the pressure of the fuel in the discharge line 80 in a manner identical to that previously described.

Figures 6, 6A:
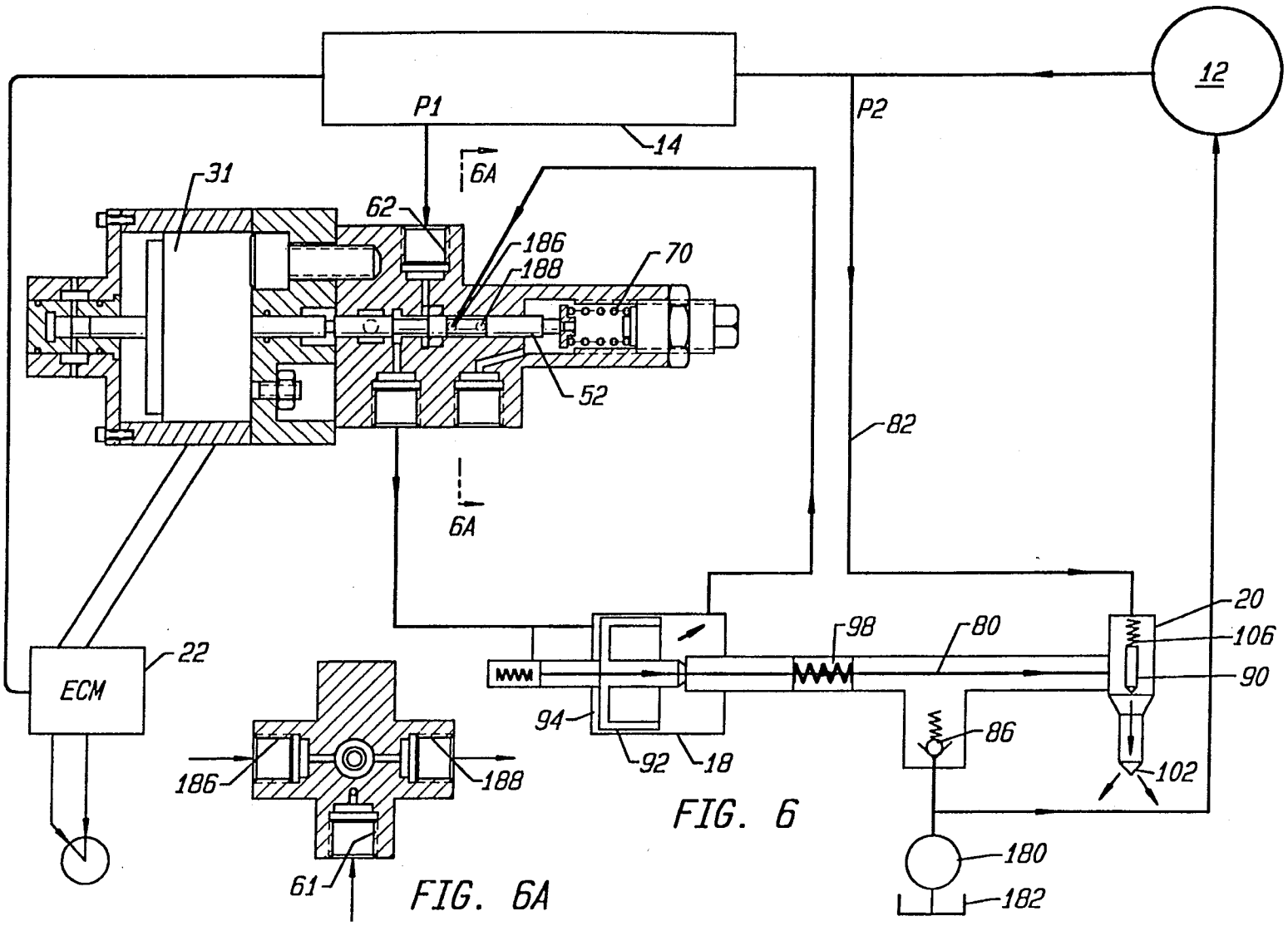
FIG. 6 is a cross sectional view, partially schematic, of an alternate fuel injector system.
FIG. 6*a* is a cross sectional view taken on the lines 6*a*—6*a* in FIG. 6.

Referring to FIGS. 6 and **6*a*, a high speed distributor is shown that supplies an injector 20 having a pressure booster 18. A low pressure pump 180 draws fuel from a fuel supply 182 and directly feeds the injector 20 through check valve 86. The booster 18 acts on the supplied fuel in high pressure discharge line 80 which on activation lifts the needle 90 for discharge of a quantity of fuel through orifices 102 as previously described. The low pressure pump 180 also supplies the high pressure pump 12 that in turn supplies the common rail 14. The high pressure fuel is delivered to the distributor through line terminal 62 and metered by actuation of the solenoid 31 controlled by the electronic control module 22 in a manner similar to that previously described. In the embodiment of FIG. 6, the slide valve 52 has an additional constricted segment 184 allowing communication of a passage from line terminal 186 to communicate with line terminal 188, as shown in FIG. 6*a*, allowing fluid behind differential piston 92 in chamber 94 to be returned to the fuel supply 182 or low pressure side of the high pressure pump 12** as convenient.

When the solenoid 31 is deactivated, the slide valve 52 is displaced by the compression spring 70 such that the constricted segment 184 is positioned to allow the communication of internal passages connecting line terminal 186 with line terminal 62 allowing high pressure fuel to be applied to the back side of the piston 92 resulting in rapid retraction of the large piston 92 and hence, cut-off of the high pressure fuel supply to the injector 20 for instant reseating of the needle valve 90 and closure of the nozzle orifices 102. The retraction is aided by compression spring 98 and the pressure of the incoming supply fuel through check valve 86. Instant drop of pressure in the line 80 causes firm and concise seating of the needle valve and prevents any post injection leakage. High pressure fuel supplied through the line 82 to the top of the needle valve 90, coupled with compression spring 106 insures that the needle displacement 90 on closure is instantaneous.

The foregoing systems are designed for use with fuel as the hydraulic fluid in actuation of the distributor booster and segments of the injector. Dual fluid systems can be employed with minor modification where a hydraulic fluid is used to actuate the components of high pressure delivery of a separate liquid fuel, which may comprise liquified natural gas or liquid hydrogen, alcohol or other fuel particularly, where it is desirable to minimize contact of the fuel with the delivery components.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An ultra high pressure fuel injector for injecting fuel at injection pressures exceeding 16,000 p.s.i. comprising:

a fuel injector component having an injector body with a pressurized fuel admission passage with a check valve means for allowing admission of fuel and preventing expulsion of fuel through the pressurized fuel admission passage;

a discharge nozzle connected to the injector body having a plenum connected to the pressurized admission passage and a nozzle tip with at least one fuel discharge orifice in selective communication with the plenum;

a displaceable needle valve having a needle with a tip, a body segment and a blunt end, the injector body having a needle valve bore in which the needle body segment is slidable, a fluid chamber in communication with the blunt end of the needle, and a valve seat in the discharge nozzle contactable by the needle tip in a position blocking the discharge orifice from communication with the plenum;

a pressurized fluid supply, the injector body having a fluid admission passage communicating with the fluid chamber;

a pressurized fluid distributing means selectively interconnecting the pressurized fluid supply and the fluid admission passage for directing pressurized fluid to the fluid chamber, wherein the needle valve tip is urged against the nozzle seat blocking the orifice by action of the pressurized fluid on the blunt end of the needle valve during the period of closure;

a booster component connected to the fuel injector component, the booster component having a pressure multiplying piston mechanism with a large piston and a coupled small piston, the small piston being in communication with the plenum and the large piston being in communication with the pressurized fluid distributing means; and actuation means for actuation of the fluid distributing means to hydraulically connect the piston mechanism with the pressurized fluid supply and displace the large and small pistons wherein fuel in the plenum is pressurized to ultra high pressure, hydraulically lifting the needle valve, and discharging a quantity of fuel through the orifice during the period of injection and hydraulically disconnecting the piston mechanism from the pressurized fluid supply during the period of closure.

2. The fuel injector of claim 1 wherein the needle valve includes a compression spring in compressed engagement with the blunt end of the needle urging the needle tip against the nozzle seat.

3. The fuel injector of claim 1 wherein the fluid distributing means, includes a solenoid with a displaceable armature and a slide valve connected to the armature, the actuation means having electronic sensing means for electronically activating the solenoid at an appropriate period in an engine cycle.

4. The fuel injector of claim 1 wherein the actuation means for actuation of the fluid distribution means is a mechanical actuator.

5. The fuel injector of claim 4 wherein the mechanical actuator is a rotating cam, wherein the fluid distributing means includes a cam follower and connected hydraulic piston means for pumping hydraulic fluid to the pressure multiplying piston mechanism.

6. The fuel injector of claim 1 wherein the pressurized fluid supply comprises a common fuel supply supplying the plenum of the injector nozzle.

7. The fuel injector of claim 1 wherein the fuel admission passage of the fuel injector component is connected to a low pressure fuel supply.

8. The fuel injector of claim 7 wherein the fuel injector has a high pressure pump and the high pressure pump is connected to the low pressure fuel supply to deliver high pressure fuel to the fluid admission passage for the fluid chamber and to the fluid distributing means.

9. The fuel injector of claim 1 comprising further a check valve having a bleed back passage with piston means on the needle valve for forcing pressurized fluid through the bleed back passage to delay instant retraction of the valve needle.

10. The fuel injector of claim 1 having further means for generating a pulsed fuel discharge through the discharge nozzle.

11. The fuel injector of claim 10 wherein the means for generating a pulsed fuel discharge comprises slide valve means on the needle of the needle valve for inducing a hydraulic instability to the hydraulic force of retraction of the needle.

12. The fuel injector of claim 1 wherein the large piston has opposite sides and the fluid distributing means has a slide valve switching means for selectively connecting the pressurized fluid supply to each of the opposite sides of the large piston wherein the piston mechanism is instantly hydraulically displaceable in opposite directions.

* * * * *